US010704117B2

(12) United States Patent
Kawamura et al.

(10) Patent No.: US 10,704,117 B2
(45) Date of Patent: Jul. 7, 2020

(54) COLD-ROLLED STEEL SHEET, COATED STEEL SHEET, METHOD FOR MANUFACTURING COLD-ROLLED STEEL SHEET, AND METHOD FOR MANUFACTURING COATED STEEL SHEET

(71) Applicant: JFE STEEL CORPORATION, Tokyo (JP)

(72) Inventors: Kenji Kawamura, Tokyo (JP); Noriaki Kohsaka, Tokyo (JP); Yoshimasa Funakawa, Tokyo (JP); Mai Aoyama, Tokyo (JP); Yoshitsugu Suzuki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 264 days.

(21) Appl. No.: 15/746,203

(22) PCT Filed: Jul. 28, 2016

(86) PCT No.: PCT/JP2016/003509
§ 371 (c)(1),
(2) Date: Jan. 19, 2018

(87) PCT Pub. No.: WO2017/017961
PCT Pub. Date: Feb. 2, 2017

(65) Prior Publication Data

US 2018/0230569 A1 Aug. 16, 2018

(30) Foreign Application Priority Data

Jul. 29, 2015 (JP) ..... 2015-149430

(51) Int. Cl.
*C21D 9/46* (2006.01)
*C22C 38/06* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 9/46; C21D 6/002; C21D 6/005; C21D 6/008; C21D 8/0205; C21D 8/0236;
(Continued)

(56) References Cited

U.S. PATENT DOCUMENTS 4,812,176 A 3/1989 Tanaka et al.
5,677,005 A 10/1997 Isobe et al.
(Continued)

FOREIGN PATENT DOCUMENTS

CN 101724776 A 6/2010
CN 101960034 A 1/2011
(Continued)

OTHER PUBLICATIONS

Chinese Office Action with Search Report for Chinese Application No. 201680043672.8, dated Dec. 21, 2018, 8 pages.
(Continued)

*Primary Examiner* — Anthony J Zimmer
*Assistant Examiner* — Ricardo D Morales
(74) *Attorney, Agent, or Firm* — RatnerPrestia

(57) ABSTRACT

Provided are a cold-rolled steel sheet which can preferably be used for manufacturing a high-strength galvanized steel sheet and methods for manufacturing the steel sheets. The cold-rolled steel sheet has a specified chemical composition, in which the Mn concentration in a surface layer of the steel sheet satisfies relational expression (1) and relational expression (2) below. $8 \leq (C_p/C_c) \times Mn$ . . . (1) $(C_{min}/C_c) \times Mn \leq 2.5$ . . . (2) where $C_p$: maximum Mn concentration in a region
(Continued)

within 0.5 μm of the surface of a steel sheet in the thickness direction; $C_c$: average Mn concentration in a region from a position located 5 μm from a surface of a steel sheet in the thickness direction to a position located 5 μm from an opposite surface in the thickness direction; $C_{min}$: minimum Mn concentration in a region from 0.5 μm to 5 μm from the surface of a steel sheet in the thickness direction; and Mn: Mn content (mass %).

8 Claims, 1 Drawing Sheet

(51) Int. Cl.

| | |
|---|---|
| ***C22C 38/60*** | (2006.01) |
| ***C21D 8/02*** | (2006.01) |
| ***C23C 2/06*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C22C 38/32*** | (2006.01) |
| ***C21D 6/00*** | (2006.01) |
| ***C23C 2/02*** | (2006.01) |
| ***C22C 38/38*** | (2006.01) |
| ***C23C 8/14*** | (2006.01) |
| ***C23C 2/28*** | (2006.01) |
| ***C23C 2/40*** | (2006.01) |
| ***C23F 17/00*** | (2006.01) |

(52) U.S. Cl.
CPC ..... *C21D 8/0205* (2013.01); *C21D 8/0236* (2013.01); *C21D 8/0247* (2013.01); *C21D 8/0273* (2013.01); *C21D 8/0278* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/32* (2013.01); *C22C 38/38* (2013.01); *C22C 38/60* (2013.01); *C23C 2/02* (2013.01); *C23C 2/06* (2013.01); *C23C 2/28* (2013.01); *C23C 2/40* (2013.01); *C23C 8/14* (2013.01); *C23F 17/00* (2013.01); *C21D 8/0226* (2013.01); *C21D 2211/002* (2013.01); *C21D 2211/005* (2013.01); *C21D 2211/008* (2013.01)

(58) Field of Classification Search
CPC .. C21D 8/0247; C21D 8/0273; C21D 8/0278; C21D 8/0226; C21D 2211/002; C21D 2211/005; C21D 2211/008; C22C 38/001; C22C 38/002; C22C 38/005; C22C 38/02; C22C 38/04; C22C 38/06; C22C 38/08; C22C 38/12; C22C 38/14; C22C 38/16; C22C 38/28; C22C 38/32; C22C 38/38; C22C 38/60; C23C 2/02; C23C 2/06; C23C 2/28; C23C 2/40; C23C 8/14; C23F 17/00
See application file for complete search history.

(56) References Cited

U.S. PATENT DOCUMENTS

| | | | | |
|---|---|---|---|---|
| 5,851,316 | A | 12/1998 | Yazawa et al. | |
| 8,133,330 | B2 | 3/2012 | Futamura et al. | |
| 2006/0172582 | A1 | 8/2006 | Fujii et al. | |
| 2013/0160907 | A1* | 6/2013 | Kawabe | C21D 9/46 148/645 |
| 2013/0236740 | A1 | 9/2013 | Kojima et al. | |
| 2013/0273391 | A1 | 10/2013 | Hamada et al. | |
| 2013/0330226 | A1 | 12/2013 | Murakami et al. | |
| 2015/0122377 | A1 | 5/2015 | Bocharova et al. | |

FOREIGN PATENT DOCUMENTS

| | | | | |
|---|---|---|---|---|
| CN | 102282280 | A | 12/2011 | |
| CN | 103080357 | A | 5/2013 | |
| CN | 103305749 | A | 9/2013 | |
| CN | 103361577 | A | 10/2013 | |
| CN | 103403210 | A | 11/2013 | |
| CN | 103717771 | A | 4/2014 | |
| CN | 104471093 | A | 3/2015 | |
| CN | 104583424 | A | 4/2015 | |
| CN | 104583445 | A | 4/2015 | |
| EP | 2182080 | A1 | 5/2010 | |
| EP | 2256224 | A1 | 12/2010 | |
| EP | 2371978 | A1 * | 10/2011 | C21D 8/0273 |
| EP | 2371978 | A1 | 10/2011 | |
| EP | 2615191 | A1 | 7/2013 | |
| EP | 2740812 | A1 | 6/2014 | |
| EP | 2873746 | A1 | 5/2015 | |
| EP | 2891727 | A1 | 7/2015 | |
| EP | 3085802 | A1 | 10/2016 | |
| EP | 3106528 | A1 | 12/2016 | |
| JP | 63169330 | A | 7/1988 | |
| JP | 04202630 | | 7/1992 | |
| JP | 10121205 | A | 5/1998 | |
| JP | 2001279411 | A | 10/2001 | |
| JP | 2001303204 | A | 10/2001 | |
| JP | 2003089851 | A | 3/2003 | |
| JP | 2006241592 | A | 9/2006 | |
| JP | 2010065314 | A | 3/2010 | |
| JP | 2014051683 | A | 3/2014 | |
| JP | 2015117403 | | 6/2015 | |
| KR | 101198470 | B1 | 11/2012 | |

OTHER PUBLICATIONS

Korean Office Action for Korean Application No. 10-2018-7001816 dated Mar. 22, 2019, with Concise Statement of Relevance of Office Action, 6 pages.
Chinese Office Action with Search Report for Chinese Application No. 201680043672.8, dated Jun. 18, 2019, 13 pages.
Extended European Search Report for European Application No. 16 830 066.3, dated Mar. 26, 2018, 9 pages.
International Search Report and Written Opinion for International Application No. PCT/JP2016/003286, dated Oct. 11, 2016—5 Pages.

* cited by examiner

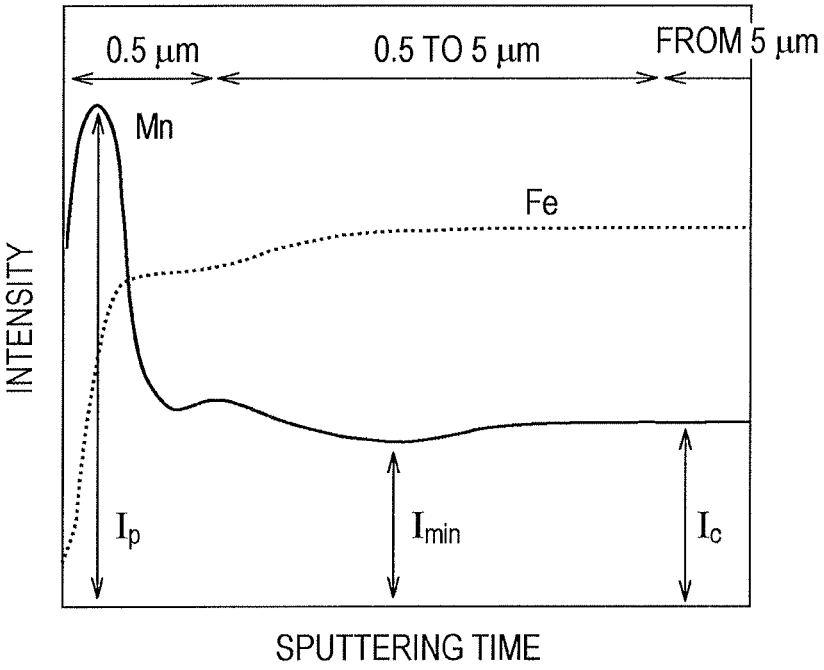
0.5 μm
0.5 TO 5 μm
FROM 5 μm
Mn
Fe
INTENSITY
$I_p$
$I_{min}$
$I_c$
SPUTTERING TIME

COLD-ROLLED STEEL SHEET, COATED STEEL SHEET, METHOD FOR MANUFACTURING COLD-ROLLED STEEL SHEET, AND METHOD FOR MANUFACTURING COATED STEEL SHEET

CROSS REFERENCE TO RELATED APPLICATIONS

This is the U.S. National Phase application of PCT/JP2016/003509, filed Jul. 28, 2016, which claims priority to Japanese Patent Application No. 2015-149430, filed Jul. 29, 2015, the disclosures of these applications being incorporated herein by reference in their entireties for all purposes.

TECHNICAL FIELD OF THE INVENTION

The present invention relates to a cold-rolled steel sheet for manufacturing a coated steel sheet having a good coating quality, a coated steel sheet which is manufactured by using the cold-rolled steel sheet, and methods for manufacturing these steel sheets.

BACKGROUND OF THE INVENTION

Nowadays, in response to growing awareness of the need to conserve the global environment, there is a strong demand for improvements in fuel efficiency in order to reduce the amount of $CO_2$ emissions from automobile. Accordingly, there is an active trend toward reducing the weight of an automobile body by reducing the thickness of automobile body parts through increasing the strength of a steel sheet, which is a material for automobile body parts.

Solid solution strengthening chemical elements such as Si and Mn are added in order to increase the strength of a steel sheet. However, since such chemical elements are easily oxidizable chemical elements which are more readily oxidized than Fe, the following problems exist in the case where a galvanized steel sheet or a galvannealed steel sheet is manufactured from a high-strength steel sheet as a base containing such chemical elements in large amounts.

Usually, in order to manufacture a galvanized steel sheet, a galvanizing treatment is performed after having heated and annealed a steel sheet in a non-oxidizing atmosphere or a reducing atmosphere at a temperature of about 600° C. to about 900° C. Easily oxidizable chemical elements in steel are selectively oxidized even in a non-oxidizing atmosphere or a reducing atmosphere which is generally used, are concentrated on the surface of a steel sheet, and form oxides on the surface of the steel sheet. Such oxides deteriorate the wettability between the surface of the steel sheet and molten zinc when a galvanizing treatment is performed, which results in coating defects. Wettability sharply deteriorates with an increase in the concentration of easily oxidizable chemical elements in steel, which increases occurrence of coating defects. In particular, Si significantly deteriorates the wettability between the surface of a steel sheet and molten zinc even in the case where the Si content is small, and thus Mn, which has a smaller effect on wettability than Si, is added to a galvanized steel sheet in many cases. However, since Mn oxides also deteriorate the wettability between the surface of a steel sheet and molten zinc, the problem of coating defects described above is significant in the case where the Mn content is large.

In response to such a problem, Patent Literature 1 proposes a method in which the wettability between the surface of a steel sheet and molten zinc is improved by heating a steel sheet in an oxidizing atmosphere in advance in order to rapidly form an Fe oxide film on the surface of a steel sheet at an oxidizing rate higher than a certain oxidizing rate for the purpose of preventing the oxidation of added chemical elements on the surface of the steel sheet and by performing thereafter reduction annealing on the Fe oxide film. However, in the case where the amounts of oxides on the surface of a steel sheet are large, iron oxides adhere to rolls in a furnace, which results in a problem of pressing flaws occurring on the surface of the steel sheet. In addition, since Mn forms a solid solution in an Fe oxide film, there is a tendency for Mn oxides to be formed on the surface of a steel sheet when reduction annealing is performed, which results in a decrease in the degree of the effect of the oxidizing treatment.

CITATION LIST

Patent Literature

PTL 1: Japanese Unexamined Patent Application Publication No. 4-202630

SUMMARY OF THE INVENTION

In view of the situation described above, an object of aspects of the present invention is to provide a cold-rolled steel sheet which can preferably be used for manufacturing a high-strength galvanized steel sheet excellent in terms of surface appearance, a coated steel sheet which is manufactured by using the cold-rolled steel sheet, and methods for manufacturing these steel sheets.

The present inventors diligently conducted investigations regarding a cold-rolled steel sheet having a chemical composition containing Si in a small amount and Mn in an amount of 1.8% or more for manufacturing a coated steel sheet excellent in terms of surface appearance and, as a result, found that a Mn concentration profile in the depth direction in a surface layer of a steel sheet before reannealing is important. Here, the term "depth direction" denotes a direction from the surface of a steel sheet to the inside of the steel sheet at a right angle to the surface (the thickness direction of the steel sheet). In addition, the Mn concentration profile is evaluated by performing sputtering analysis. The term "sputtering analysis" denotes an analysis method in which the surface of a steel sheet is gradually eroded through the impact of ions in order to successively observe the atoms or secondary ions of, for example, Fe, Mn, and Si, which are released from the steel sheet by the impact, by performing, for example, spectroscopic analysis or mass spectrometry. Therefore, usually, by plotting the determined intensity (I) of each of chemical elements such as Fe, Mn, and Si for the sputtering time, which represents the depth from the surface of a steel sheet, and by connecting the plotted points, it is possible to derive the distribution of each of the chemical elements in the depth direction of the steel sheet, that is, a profile in the depth direction. A GDS (glow discharge optical emission spectrometer) is used as a surface analysis apparatus for performing sputtering analysis. This is because, by using a GDS, it is possible to perform sputtering analysis in the depth direction with good sensitivity and in a short analysis time. Here, FIG. 1 is a schematic diagram illustrating an example of a concentration profile in the thickness direction derived by using a GDS. $I_p$ corresponds to $C_p$, $I_{min}$ corresponds to $C_{min}$, and $I_c$ corresponds to $C_c$.

Aspects of the present invention have been completed on the basis of the knowledge described above, and the subject matter of aspects of the present invention is as follows.

[1] A cold-rolled steel sheet having a chemical composition containing, by mass %, C: 0.06% or more and 0.20% or less, Si: less than 0.30%, Mn: 1.8% or more and 3.2% or less, P: 0.03% or less, S: 0.005% or less, Al: 0.08% or less, N: 0.0070% or less, and the balance being Fe and inevitable impurities, in which the Mn concentration in a surface layer of the steel sheet satisfies relational expression (1) and relational expression (2) below.

$$8 \leq (C_p/C_c) \times Mn \quad (1)$$

$$(C_{min}/C_c) \times Mn \leq 2.5 \quad (2)$$

$C_p$: maximum Mn concentration in a region within 0.5 μm of a surface of a steel sheet in the thickness direction $C_c$: average Mn concentration in a region from a position located 5 μm from the surface of a steel sheet in the thickness direction to a position located 5 μm from an opposite surface in the thickness direction $C_{min}$: minimum Mn concentration in a region from 0.5 μm to 5 μm from the surface of a steel sheet in the thickness direction Mn: Mn content (mass %)

[2] The cold-rolled steel sheet according to item [1], in which the steel sheet has the chemical composition further containing, by mass %, one, two, or more of Ti: 0.005% or more and 0.060% or less, V: 0.001% or more and 0.3% or less, W: 0.001% or more and 0.2% or less, Nb: 0.001% or more and 0.08% or less, and Cu: 0.001% or more and 0.5% or less.

[3] The cold-rolled steel sheet according to item [1] or [2], in which the steel sheet has the chemical composition further containing, by mass %, one, two, or more of Cr: 0.001% or more and 0.8% or less, Ni: 0.001% or more and 0.5% or less, Mo: 0.001% or more and 0.5% or less, and B: 0.0001% or more and 0.0030% or less.

[4] The cold-rolled steel sheet according to any one of items [1] to [3], in which the steel sheet has the chemical composition further containing, by mass %, one, two, or more of REM, Mg, Ca, and Sb in a total amount of 0.0002% or more and 0.01% or less.

[5] A coated steel sheet having a coating layer on the surface of the cold-rolled steel sheet according to any one of items [1] to [4].

[6] A method for manufacturing the cold-rolled steel sheet according to any one of items [1] to [4], the method including performing annealing on a cold-rolled steel sheet under conditions that a heating rate in a temperature range of 600° C. or higher and lower than the Act transformation temperature is 5° C./s or less, a heating rate in a temperature range from the Act transformation temperature to an annealing temperature is 2° C./s or more, the annealing temperature is equal to or higher than the Ac1 transformation temperature and 860° C. or lower, and an annealing time is 10 seconds or more and 200 seconds or less.

[7] A method for manufacturing a coated steel sheet, the method including performing a coating treatment on the surface of the cold-rolled steel sheet according to any one of items [1] to [4].

According to aspects of the present invention, it is possible to obtain a cold-rolled steel sheet for manufacturing a coated steel sheet excellent in terms of surface appearance which can preferably be used for, for example, the structural members of an automobile. Since it is possible to manufacture a high-strength coated steel sheet excellent in terms of surface appearance, it is possible to improve collision safety of an automobile and to improve fuel efficiency as a result of the weight reduction of automobile parts.

BRIEF DESCRIPTION OF THE DRAWINGS

FIG. 1 is a schematic diagram illustrating an example of a concentration profile in the thickness direction derived by using a GDS.

DETAILED DESCRIPTION OF EMBODIMENTS OF THE INVENTION

Hereafter, the embodiments of the present invention will be described. Here, the present invention is not limited to the embodiments described below.

<Cold-Rolled Steel Sheet>

The cold-rolled steel sheet according to aspects of the present invention has a chemical composition containing, by mass %, C: 0.06% or more and 0.20% or less, Si: less than 0.30%, Mn: 1.8% or more and 3.2% or less, P: 0.03% or less, S: 0.005% or less, Al: 0.08% or less, N: 0.0070% or less, and the balance being Fe and inevitable impurities.

In addition, the chemical composition described above may further contain, by mass %, one, two, or more of Ti: 0.005% or more and 0.060% or less, V: 0.001% or more and 0.3% or less, W: 0.001% or more and 0.2% or less, Nb: 0.001% or more and 0.08% or less, and Cu: 0.001% or more and 0.5% or less as optional constituent chemical elements.

In addition, the chemical composition described above may further contain, by mass %, one, two, or more of Cr: 0.001% or more and 0.8% or less, Ni: 0.001% or more and 0.5% or less, Mo: 0.001% or more and 0.5% or less, and B: 0.0001% or more and 0.0030% or less as optional constituent chemical elements.

In addition, the chemical composition described above may further contain, by mass %, one, two, or more of REM, Mg, Ca, and Sb in a total amount of 0.0002% or more and 0.01% or less as optional constituent chemical elements.

Hereafter, the reasons for the limitations of the chemical composition of the cold-rolled steel sheet according to aspects of the present invention will be described. Here, "%" used when describing a chemical composition means "mass %", unless otherwise noted.

C: 0.06% or more and 0.20% or less

C is a chemical element which is indispensable for increasing the strength of a steel sheet. It is necessary that the C content be 0.06% or more in order to achieve a tensile strength of 780 MPa or more in the case of the coated steel sheet which is manufactured by using the cold-rolled steel sheet according to aspects of the present invention. On the other hand, in the case where the C content is more than 0.20%, there may be an increased deterioration in workability. Therefore, the C content is set to be 0.06% or more and 0.20% or less. It is preferable that the upper limit and lower limit of the C content be respectively within the following ranges from the viewpoint of weldability. It is preferable that the lower limit of the C content be 0.07% or more. It is preferable that the upper limit of the C content be 0.18% or less, or more preferably 0.17% or less.

Si: less than 0.30%

Si is a chemical element which forms ferrite and which is effective for solid-solution strengthening of ferrite of an annealed steel sheet and for improving work hardening capability. Although Si is not necessarily added, it is preferable that the Si content be 0.05% or more in order to realize such effects. However, Si is also a chemical element which significantly deteriorates coatability. In particular, in the case where the Si content is 0.30% or more, since Si forms oxides on the surface of a steel sheet during annealing, there is a deterioration in coatability. Therefore, the Si content is set to be less than 0.30%, or preferably 0.25% or less.

Mn: 1.8% or more and 3.2% or less

Mn is a chemical element which is effective for increasing the strength of steel. It is necessary that the Mn content be 1.8% or more in order to achieve a tensile strength of 780 MPa or more in the case of the coated steel sheet which is manufactured by using the cold-rolled steel sheet according to aspects of the present invention. On the other hand, in the case where the Mn content is more than 3.2%, a surface layer, which is formed as a result of large amounts of oxides being formed on the surface of a steel sheet during final annealing (re-annealing), deteriorates coating surface appearance, even if a Mn concentration profile is controlled before the final annealing. It is preferable that the lower limit of the Mn content be 1.9% or more. It is preferable that the upper limit of the Mn content be 3.0% or less.

P: 0.03% or less

P segregated at grain boundaries forms voids due to segregation when cold rolling is performed. Since there is a deterioration in shape when cold rolling is performed as a result of the formation of voids, it is preferable that the P content be as small as possible. The P content is allowed to be 0.03% or less, or preferably 0.02% or less, in accordance with aspects of the present invention. Although P is not necessarily added in the present invention and it is preferable that the P content be as small as possible, there may be a case where P is inevitably mixed in steel in a manufacturing process in an amount of at least 0.001%.

S: 0.005% or less

S exists in the form of inclusions such as MnS in steel. Since such inclusions significantly deteriorate the workability of a steel sheet, in particular, bendability, it is preferable that the S content be as small as possible, and the S content is set to be 0.005% or less, or preferably 0.003% or less. It is preferable that the S content be 0.001% or less, in particular, in the case of use as a material which is strictly required to have satisfactory bendability.

Al: 0.08% or less

In the case where the Al content is excessively large, there is a deterioration in surface quality and formability due to an increase in the amount of oxide-based inclusions. Also, in the case where the Al content is excessively large, there is an increase in cost. Therefore, the Al content is set to be 0.08% or less, or preferably 0.05% or less.

N: 0.0070% or less

Since N is the chemical element which most significantly deteriorates the aging resistance of steel, it is preferable that the N content be as small as possible. Therefore, N is not necessarily added. In the case where the N content is more than 0.0070%, there is a significant deterioration in aging resistance. Therefore, the N content is set to be 0.0070% or less. Here, since there is a significant increase in manufacturing costs in the case where the N content is controlled to be less than 0.0010%, it is preferable that the lower limit of the N content be 0.0010% from the viewpoint of manufacturing costs.

The chemical composition described above is the basic chemical composition according to aspects of the present invention, and the chemical composition may contain the following chemical elements instead of a part of Fe, which is a base constituent chemical element, as described above.

Containing one, two, or more of Ti: 0.005% or more and 0.060% or less, V: 0.001% or more and 0.3% or less, W: 0.001% or more and 0.2% or less, Nb: 0.001% or more and 0.08% or less, and Cu: 0.001% or more and 0.5% or less Although the above-mentioned chemical elements are chemical elements which contribute to an increase in the strength of a steel sheet by forming carbides, there is a negative effect on the formability of a steel sheet in the case where the contents of these chemical elements are excessively large. Therefore, the Ti content is set to be 0.005% or more and 0.060% or less, the V content is set to be 0.001% or more and 0.3% or less, the W content is set to be 0.001% or more and 0.2% or less, the Nb content is set to be 0.001% or more and 0.08% or less, and the Cu content is set to be 0.001% or more and 0.5% or less.

Containing one, two, or more of Cr: 0.001% or more and 0.8% or less, Ni: 0.001% or more and 0.5% or less, Mo: 0.001% or more and 0.5% or less, and B: 0.0001% or more and 0.0030% or less The above-mentioned chemical elements are chemical elements which are effective for inhibiting the formation of pearlite when cooling is performed from an annealing temperature. On the other hand, in the case where the contents of these chemical elements are excessively large, since there is an excessive increase in the amount of hard martensite, there is an increase in strength more than necessary, which results a deterioration in workability. Therefore, the Cr content is set to be 0.001% or more and 0.8% or less, the Ni content is set to be 0.001% or more and 0.5% or less, the Mo content is set to be 0.001% or more and 0.5% or less, and the B content is set to be 0.0001% or more and 0.0030% or less.

Containing one, two, or more of REM, Mg, Ca, and Sb in a total amount of 0.0002% or more and 0.01% or less REM (REM: lanthanoid elements having atomic numbers of 57 through 71), Mg, Ca, and Sb are effective for inhibiting the formation of voids when press forming is performed as a result of decreasing the degree of stress concentration around cementite by controlling the shape of cementite, which is precipitated around bainite, to be spherical. In addition, Sb is effective for inhibiting the formation of an abnormal microstructure in a surface layer and contributes to an improvement in bendability. On the other hand, in the case where the total content of any one, two, or more of REM, Mg, Ca, and Sb is more than 0.01%, the effect of controlling the shape of cementite becomes saturated, and there is a negative effect on ductility. Therefore, the total content of one, two, or more of REM, Mg, Ca, and Sb is set to be 0.0002% or more and 0.01% or less, or preferably 0.0005% or more and 0.005% or less.

Constituent chemical elements other than those described above are Fe and inevitable impurities. The meaning of the term "inevitable impurities" includes constituent chemical elements which are inevitably mixed in steel in a manufacturing process, constituent chemical elements which are added within ranges in which there is no decrease in the effects of aspects of the present invention, and, for example, the optional constituent chemical elements described above in the case where the contents of such optional constituent chemical elements are less than the lower limits of their content ranges described above.

Aspects of the present invention are characterized in that the chemical composition is controlled and in that a Mn concentration profile is controlled as described above. Hereafter, the reasons for the limitation on the Mn concentration profile in the surface layer of the cold-rolled steel sheet according to aspects of the present invention will be described.

The term "a Mn concentration profile in the surface layer of a cold-rolled steel sheet is controlled" specifically means that a Mn concentration in the surface layer of a steel sheet is controlled so as to satisfy relational expression (1) and relational expression (2) below.

$$8 \leq (C_p/C_c) \times Mn \quad (1)$$

$$(C_{min}/C_c) \times Mn \leq 2.5 \quad (2)$$

$C_p$: maximum Mn concentration in a region within 0.5 μm of the surface of a steel sheet in the thickness direction $C_c$: average Mn concentration in a region from a position located 5 μm from the surface of a steel sheet in the thickness direction to a position located 5 μm from the opposite surface in the thickness direction $C_{min}$: minimum Mn concentration in a region from 0.5 μm to 5 μm from the surface of a steel sheet in the thickness direction Mn: Mn content (mass %)

The coatability of a hot-dip zinc-based coating layer depends on the absolute amount of Mn which exists in the surface layer of a steel sheet (a region within 0.5 μm of the surface of a steel sheet in the thickness direction, that is, a region from the surface of a steel sheet to a position located 0.5 μm in depth in the thickness direction), and it is preferable that such absolute amount of Mn be decreased. Since the Mn content in the chemical composition of the cold-rolled steel sheet according to aspects of the present invention is large, that is, 1.8% to 3.2%, surface concentration progresses to some extent by performing annealing. It was found that, in the case where relational expression (1) and relational expression (2) above are satisfied, by removing Mn oxides when performing subsequent pickling, it is possible to achieve a good coating quality after re-annealing, leading to the completion of an aspect of the present invention. That is, in the case where $(C_p/C_c) \times Mn$ is 8 or more while relational expression (2) is satisfied, good coatability is achieved. In the case where $(C_p/C_c) \times Mn$ is less than 8, since a Mn-depleted layer is not formed due to the surface concentration of Mn being insufficient in prior annealing, the surface concentration of Mn occurs in re-annealing even if Mn oxides in the surface layer is removed by performing pickling following the prior annealing, which results in a deterioration in coatability. Here, although there is no particular limitation on the upper limit of $(C_p/C_c) \times Mn$, it is preferable that the upper limit be 20 or less. This is because, in the case where $(C_p/C_c) \times Mn$ is more than 20, since significant amount of Mn oxides is formed on the surface of a steel sheet, the Mn oxides are transferred to furnace rolls when continuous annealing is performed, which may result in flaws occurring on the surface of a steel sheet.

Relational expression (2) above relates to an index regarding a Mn-depleted layer which is formed by performing prior annealing. In the case where Mn oxides in the surface layer, which are formed by performing prior annealing, are simply removed by performing pickling before re-annealing is performed, there may be a case where Mn in the inner layer of a steel sheet is concentrated on the surface when re-annealing is performed, which may result in a deterioration in coatability. It is necessary that $(C_{min}/C_c) \times Mn$ be 2.5 or less, or preferably 2.0 or less, in order to achieve good coatability. Here, it is preferable that $(C_{min}/C_c) \times Mn$ be 1.5 or more. This is because, if $(C_{min}/C_c) \times Mn$ is less than 1.5, there may be a case of a deterioration in the surface appearance of a coated steel sheet which is manufactured by using the cold-rolled steel sheet.

Although there is no particular limitation on the metallographic structure of the cold-rolled steel sheet according to aspects of the present invention, it is preferable that the structure be as described below from the viewpoint of improving workability after re-annealing.

First, it is preferable that the steel microstructure of the cold-rolled steel sheet according to aspects of the present invention include martensite from the viewpoint of achieving a tensile strength of 780 MPa or more after re-annealing has been performed. Since homogeneous microstructure is formed even in short-time annealing as a result of austenite being preferentially formed from martensite when re-annealing is performed, it is possible to obtain a cold-rolled steel sheet excellent in terms of workability. It is preferable that martensite be included in an amount of 30% to 70% in terms of area fraction.

Here, the steel sheet microstructure was identified by using the method described below. The steel sheet microstructure was identified and the area ratio of martensite was determined by using a microstructure photograph (SEM photograph) of a position located at a depth of ⅜ in the thickness of a steel sheet which had been obtained by taking a test sample for microstructure observation from a cold-rolled steel sheet, by mechanically polishing the L-cross section (vertical cross section parallel to the rolling direction) of the sample, by etching the polished cross section through the use of nital, and by taking a photograph through the use of a scanning electron microscope (SEM) at a magnification of 3000 times. The area ratio of martensite was determined by using a coloring method through the use of image analysis software.

It is preferable that ferrite and bainite be included along with martensite.

It is not preferable that the strength of the cold-rolled steel sheet according to aspects of the present invention be high more than necessary, because this results in an increase in load placed on equipment in the following manufacturing process. Therefore, it is preferable that one or both of ferrite and bainite, which are softer than martensite, be included. It is preferable that the total amount of ferrite and bainite included (the amount of ferrite or bainite in the case where only one of ferrite and bainite is included) along with martensite be 30% to 70% in terms of area fraction.

It is preferable that the steel microstructure according to aspects of the present invention include martensite, ferrite, and bainite in a total amount of 90% or more, or more preferably 95% or more, in terms of area ratio, and it is most preferable that the structure be composed of martensite, ferrite, and bainite.

<Coated Steel Sheet>

The coated steel sheet according to aspects of the present invention is a coated steel sheet having a coating layer on the surface of the cold-rolled steel sheet according to aspects of the present invention described above. There is no particular limitation on the kind of coating, and the meaning of the term "a coating layer" also includes an alloyed coating layer.

<Method for Manufacturing Cold-Rolled Steel Sheet>

Hereafter, the method for manufacturing the cold-rolled steel sheet according to aspects of the present invention will be described. By performing rough rolling and finish rolling on a steel slab having the chemical composition described above in a hot rolling process, by removing scale from the surface of the hot-rolled steel sheet in a pickling process, by performing cold rolling on the pickled steel sheet, and by finally performing annealing (also referred to as "prior annealing"), the cold-rolled steel sheet according to aspects of the present invention is obtained. Hereafter, specific manufacturing conditions will be described. Here, the term "heating rate" and "cooling rate" in the description below respectively denote "average heating rate" and "average cooling rate".

In accordance with aspects of the present invention, there is no particular limitation on the method used for preparing molten steel, and a known method for preparing molten steel such as one which utilizes a converter or an electric furnace, for example, may be used. In addition, secondary refining may be performed by using a vacuum degassing furnace. In addition, it is preferable that an electromagnetic induction stirring treatment be performed on the molten inner layer of a slab in order to homogenize an inclusion distribution in the slab.

In addition, there is no particular limitation on the conditions of a hot rolling process or the conditions of a pickling process, and the conditions may be set appropriately. In the case where the finishing temperature of hot rolling is equal to or lower than the Ar3 transformation temperature, since it is difficult to make up a homogeneous steel microstructure due to, for example, the formation of grains having a large grain size in a surface layer, there may be a case where it is not possible to achieve stable punching capability. Therefore, it is preferable that the finishing temperature (finish rolling delivery temperature) be equal to or higher than the Ar3 transformation temperature. In addition, although there is no particular limitation on the upper limit of the finishing temperature, it is preferable that the finishing temperature be 1000° C. or lower. In the case where a coiling temperature is higher than 700° C., there may be a problem of surface defects caused by scale generated in a hot rolling process. Therefore, it is preferable that the coiling temperature be 700° C. or lower, or more preferably 650° C. or lower. In addition, it is preferable that the coiling temperature be 500° C. or lower in order to inhibit a variation in material properties over the whole length of a hot-rolled steel sheet. On the other hand, in the case where the coiling temperature is lower than 350° C., since there is an excessive increase in the hardness of a hot-rolled steel sheet due to the formation of martensite, there is an increase in cold rolling load. Therefore, it is preferable that the coiling temperature be 350° C. or higher. It is more preferable that the coiling temperature be 400° C. or higher in order to inhibit an excessive increase in hardness.

Although there is no particular limitation on cold rolling conditions, it is preferable that a rolling reduction ratio be 80% or less, or more preferably 75% or less, because there is a significant increase in rolling load in the case where the rolling reduction ratio is more than 80%. On the other hand, in the case where the rolling reduction ratio is excessively low, there is a tendency for grains to have large and various sizes after annealing. Therefore, it is preferable that the rolling reduction ratio be 35% or more.

The condition of prior annealing will be described. It is preferable that this prior annealing be performed by using a continuous annealing method in order to increase productivity. In the prior annealing process, Mn is oxidized on the surface of a steel sheet only to the extent that Fe is not oxidized.

Heating Rate of Prior Annealing

It is necessary that the heating rate of prior annealing be 5° C./s or less in a temperature range of 600° C. or higher and lower than the Act transformation temperature in order to control the surface concentration of Mn. In the case where the heating rate in the above-mentioned temperature range is more than 5° C./s, relational expression (1) or relational expression (2) is not satisfied, which results in unsatisfactory coatability after re-annealing. It is preferable that the heating rate be 3.5° C./s or less. Here, it is preferable that the heating rate described above be 1° C./s or more from the viewpoint of productivity.

In addition, the heating rate is set to be 2° C./s or more, or preferably 2.5° C./s or more, in a temperature range from the Act transformation temperature to an annealing temperature in order to decrease the absolute amount of Mn concentrated on the surface. Here, it is preferable that the heating rate described above be 10° C./s or less in consideration of the heating capability of a heating furnace.

Here, the Act transformation temperature is defined by the equation $Ac1=723+29.1\times Si-10.7\times Mn-16.9Ni+16.9Cr+6.38\ W$ (each of the atomic symbols in the equation denotes the content (mass %) of the corresponding chemical element and is assigned a value of 0 mass % in the case where the corresponding chemical element is not added).

Annealing Temperature of Prior Annealing

The annealing temperature of prior annealing is equal to or higher than the Ac1 transformation temperature and 860° C. or lower. By controlling the annealing temperature to be equal to or higher than Ac1 transformation temperature, the steel microstructure after re-annealing becomes homogeneous and thus it is possible to achieve the desired properties. In the case where the annealing temperature is lower than the Act transformation temperature, the oxidation of Mn is insufficient and an inhomogeneous microstructure tends to be formed even after re-annealing has been performed and thus it is not possible to achieve the desired properties. In addition, it is not preferable that the annealing temperature of prior annealing be higher than 860° C., because this results in a deterioration in properties after re-annealing due to the grain size of a microstructure being increased and because this results in unsatisfactory energy efficiency. Therefore, the annealing temperature of prior annealing is set to be equal to or higher than the Act transformation temperature and 860° C. or lower.

Annealing Time of Prior Annealing

In addition, the annealing time of prior annealing is 10 seconds or more and 200 seconds or less. In the case where the annealing time of prior annealing is less than 10 seconds, sufficient recrystallization does not progress, and therefore it is not possible to obtain a steel sheet having desired properties. On the other hand, in the case where the annealing time is more than 200 seconds, there is an increase in manufacturing costs due to an increase in energy consumption, and it is not possible to achieve the desired properties as a result of relational expression (1) or relational expression (2) being unsatisfied. Therefore, the annealing time of prior annealing is set to be 10 seconds or more and 200 seconds or less.

Cooling Rate of Prior Annealing

In addition, although there is no particular limitation on the cooling rate (average cooling rate) of prior annealing, it is preferable that the cooling rate be controlled to be 10° C./s or more at least in a temperature range from the annealing temperature of prior annealing to 550° C. in order to facilitate the formation of a homogeneous microstructure after re-annealing. In the case where the average cooling rate is less than 10° C./s, a large amount of pearlite may be formed, and there may be a case where it is not possible to form a multi-phase microstructure including ferrite, martensite, and bainite. Although there is no particular limitation on the upper limit of the cooling rate, it is preferable that the cooling rate be 200° C./s or less because deterioration in the shape of a steel sheet may be occurred in some cases. It is preferable that the lower limit of the cooling rate be 20° C./s or more. It is preferable that the upper limit of the cooling rate be 50° C./s or less. In addition, the cooling stop temperature of cooling in prior annealing is about 100° C. to about 400° C.

<Method for Manufacturing Coated Steel Sheet>

It is possible to manufacture the coated steel sheet according to aspects of the present invention by performing a coating treatment on the cold-rolled steel sheet which has been manufactured as described above. A coated steel sheet (for example, a galvanized steel sheet or a galvannealed steel sheet) which is manufactured by using the cold-rolled steel sheet according to aspects of the present invention is excellent in terms of surface appearance. Here, pickling, re-annealing, and a coating treatment (coating treatment involving an alloying treatment as needed) are performed on the cold-rolled steel sheet in order to manufacture a coated steel sheet, and the conditions of such processes should be appropriately determined.

EXAMPLES

Molten steels containing the chemical compositions given in Table 1 and the balance being Fe and inevitable impurities were prepared by using a converter, and slabs were manufactured by using a continuous casting method. The obtained slabs were heated to a temperature of 1200° C., and the heated slabs were hot-rolled to a thickness of 2.3 mm to 4.5 mm under the conditions of a finish rolling delivery temperature of 850° C. to 880° C. and a coiling temperature of 450° C. to 500° C. Subsequently, the concentrations of chemical elements in the surface layer (Mn surface concentration profiles) of steel sheets which had been manufactured by performing pickling and cold rolling with a rolling reduction ratio of 60% followed by annealing on the obtained hot-rolled steel sheets were investigated. Subsequently, the obtained cold-rolled steel sheets were subjected to pickling and re-annealing followed by galvanizing treatment in order to obtain galvanized steel sheets (some of the steel sheets were subjected to an alloying treatment).

The Mn surface concentration profiles of the cold-rolled steel sheets which had been manufactured as described above were investigated, and the surface appearance of the galvanized steel sheets was investigated.

<Surface Concentration Profile>

Sputtering analysis in the depth direction was performed on the surface of the cold-rolled steel sheet by using a GDS (model designation: GDLS-5017, produced by SHIMADZU CORPORATION) under the conditions of an Ar flow rate of 500 ml/min and a discharge current of 20 mA. From the obtained GDS profile in the depth direction, the maximum peak height of Mn in the surface layer (a region within 0.5 μm of the surface of a steel sheet in the thickness direction), the average peak height in the inner layer of the steel sheet (average Mn concentration in a region from a position located 5 μm from the surface of a steel sheet in the thickness direction to a position located 5 μm from the opposite surface in the thickness direction), and the minimum peak height in a region from 0.5 μm to 5 μm from the surface of a steel sheet in the thickness direction were determined, and $(C_p/C_c)\times Mn$ and $(C_{min}/C_c)\times Mn$ in relational expression (1) and relational expression (2) were calculated.

<Surface Appearance>

By judging whether or not an appearance defect such as a coating defect or a pinhole existed under visual observation, a case where no appearance defect existed was judged as good (○), a case where surface appearance was generally good with only a small amount of appearance defects was judged as generally good (Δ), and a case where appearance defects existed was judged as (x).

TABLE 1

| | mass % | | | | | | | | | | | | | | | | | |
|---|---|---|---|---|---|---|---|---|---|---|---|---|---|---|---|---|---|---|
| | C | Si | Mn | P | S | Al | N | Ti | Nb | V | B | Cr | Mo | Cu | Ni | Other | Ac1 (° C.) | Note |
| A | 0.10 | 0.23 | 2.58 | 0.008 | 0.0008 | 0.024 | 0.0035 | 0.018 | 0.040 | | 0.0010 | | | | | | 702 | Example |
| B | 0.12 | 0.05 | 2.21 | 0.012 | 0.0011 | 0.034 | 0.0028 | 0.021 | 0.023 | 0.03 | 0.0012 | | | | | | 701 | Example |
| C | 0.09 | 0.12 | 2.26 | 0.015 | 0.0014 | 0.034 | 0.0024 | | 0.041 | | 0.0015 | | | | | | 702 | Example |
| D | 0.11 | 0.21 | 2.45 | 0.023 | 0.0005 | 0.035 | 0.0033 | | | | | | | | | W: 0.005 | 703 | Example |
| E | 0.06 | 0.11 | 2.31 | 0.021 | 0.0012 | 0.044 | 0.0041 | 0.024 | 0.015 | | | | 0.12 | | | Mg: 0.0001<br>Sb: 0.0002 | 701 | Example |
| F | 0.09 | 0.13 | 2.55 | 0.023 | 0.0013 | 0.036 | 0.0027 | 0.022 | | | 0.0012 | 0.21 | | | | REM: 0.0002<br>Ca: 0.0002 | 703 | Example |
| G | 0.16 | 0.02 | 2.56 | 0.024 | 0.0009 | 0.034 | 0.0035 | 0.035 | 0.028 | | 0.0013 | | | 0.21 | 0.11 | | 694 | Example |
| H | 0.07 | 0.03 | 2.54 | 0.019 | 0.0007 | 0.036 | 0.0036 | 0.058 | 0.024 | | 0.0015 | | | | | Sb: 0.0080 | 697 | Example |
| I | 0.17 | 0.26 | 1.44 | 0.018 | 0.0008 | 0.035 | 0.0046 | 0.041 | 0.020 | | 0.0014 | | | | | | 715 | Comparative Example |
| J | 0.05 | 0.24 | 2.23 | 0.023 | 0.0012 | 0.035 | 0.0025 | 0.025 | 0.023 | | 0.0014 | | | | | | 706 | Comparative Example |
| K | 0.13 | 0.13 | 3.51 | 0.024 | 0.0011 | 0.036 | 0.0024 | 0.024 | 0.012 | | 0.0012 | | | | | | 689 | Comparative Example |
| L | 0.11 | 0.45 | 2.42 | 0.022 | 0.0013 | 0.034 | 0.0047 | 0.019 | 0.015 | | 0.0013 | | | | | | 710 | Comparative Example |

*An underlined portion indicates a value out of the range according to the present invention.

TABLE 2

| Steel Sheet | Steel | Prior Annealing: Annealing Temperature (° C.) | Annealing Time (s) | Heating Rate in Temperature Range of 600° C. or Higher and Lower than Ac1 Transformation Temperature (° C./s) | Heating Rate in Temperature Range from Ac1 Transformation Temperature to Prior Annealing Temperature (° C./s) | (Cp/Cc) × Mn *1 | (Cmin/Cc) × Mn *2 | Surface Appearance | Note |
|---|---|---|---|---|---|---|---|---|---|
| 1 | A | 840 | 50 | 3.4 | 2.8 | 14.0 | 2.1 | ○ | Example |
| 2 | | 840 | 50 | 10.2 | 2.8 | 8.6 | 2.6 | Δ | Comparative Example |
| 3 | | 840 | 50 | 3.4 | 0.3 | 7.1 | 2.2 | Δ | Comparative Example |
| 4 | B | 820 | 50 | 2.9 | 4.1 | 10.5 | 1.9 | ○ | Example |
| 5 | | 850 | 300 | 3.3 | 3.3 | 7.5 | 2.1 | Δ | Comparative Example |
| 6 | | 880 | 50 | 3.3 | 3.3 | 6.8 | 1.8 | x | Comparative Example |
| 7 | C | 840 | 50 | 3.4 | 2.6 | 9.6 | 1.9 | ○ | Example |
| 8 | | 700 | 50 | 3.4 | 2.6 | 4.2 | 2.2 | x | Comparative Example |
| 9 | D | 820 | 50 | 3.4 | 2.6 | 9.3 | 1.8 | ○ | Example |
| 10 | E | 820 | 50 | 12.1 | 5.1 | 7.3 | 2.2 | Δ | Comparative Example |
| 11 | | 820 | 50 | 2.2 | 3.1 | 8.5 | 2.2 | ○ | Example |
| 12 | F | 820 | 50 | 3.4 | 2.6 | 9.0 | 2.1 | ○ | Example |
| 13 | G | 820 | 50 | 3.4 | 2.6 | 10.2 | 2.2 | ○ | Example |
| 14 | H | 820 | 50 | 2.9 | 4.1 | 11.0 | 2.0 | ○ | Example |
| 15 | I | 800 | 50 | 0.3 | 2.6 | 6.5 | 1.4 | x | Comparative Example |
| 16 | J | 820 | 50 | 3.3 | 2.6 | 8.0 | 1.8 | ○ | Comparative Example |
| 17 | K | 820 | 50 | 3.3 | 2.6 | 12.1 | 2.9 | x | Comparative Example |
| 18 | L | 840 | 50 | 3.3 | 2.6 | 9.8 | 2.1 | x | Comparative Example |

*An underlined portion indicates a value out of the range according to the present invention.
*1: the calculated value of (Op/Cc) × Mn in equation (1)
*2: the calculated value of (Cmin/Cc) × Mn in equation (2)

All the high-strength galvanized steel sheets which were manufactured by using the cold-rolled steel sheets of the examples of the present invention were excellent in terms of surface appearance. In addition, the examples had a tensile strength (TS) of 780 MPa or more. In addition, the steel microstructures of the examples included martensite in an amount of 30% to 70% in terms of area ratio and ferrite and bainite in a total amount of 70% to 30% in terms of area ratio. On the other hand, the comparative examples were poor in terms of at least one of tensile strength and surface appearance. Specifically, No. 16 had a tensile strength of less than 780 MPa.

The invention claimed is:

1. A cold-rolled steel sheet having a chemical composition containing, by mass %, C: 0.06% or more and 0.20% or less, Si: less than 0.30%, Mn: 1.8% or more and 3.2% or less, P: 0.03% or less, S: 0.005% or less, Al: 0.08% or less, N: 0.0070% or less, and the balance being Fe and inevitable impurities, wherein the Mn concentration in a surface layer of the steel sheet satisfies relational expression (1) and relational expression (2) below:

$$8 \leq (C_p/C_c) \times Mn \quad (1),$$

$$(C_{min}/C_c) \times Mn \leq 2.5 \quad (2), \text{ where}$$

$C_p$: maximum Mn concentration in a region within 0.5 μm of a surface of a steel sheet in the thickness direction, $C_c$: average Mn concentration in a region from a position located 5 μm from the surface of a steel sheet in the thickness direction to a position located 5 μm from an opposite surface in the thickness direction, $C_{min}$: minimum Mn concentration in a region from 0.5 μm to 5 μm from the surface of a steel sheet in the thickness direction, and Mn: Mn content (mass %).

2. The cold-rolled steel sheet according to claim 1, wherein the steel sheet has the chemical composition further containing, by mass %, one, two, or more of element(s) from at least one of the following groups 1 to 3:

group 1: Ti: 0.005% or more and 0.060% or less, V: 0.001% or more and 0.3% or less, W: 0.001% or more and 0.2% or less, Nb: 0.001% or more and 0.08% or less, and Cu: 0.001% or more and 0.5% or less;

group 2: Cr: 0.001% or more and 0.8% or less, Ni: 0.001% or more and 0.5% or less, Mo: 0.001% or more and 0.5% or less, and B: 0.0001% or more and 0.0030% or less; and group 3: REM, Mg, Ca, and Sb in a total amount of 0.0002% or more and 0.01% or less.

3. A coated steel sheet having a coating layer on the surface of the cold-rolled steel sheet according to claim 1.

4. A method for manufacturing the cold-rolled steel sheet according to claim 1, the method comprising performing annealing on a cold-rolled steel sheet under conditions including a two-step heating process, the two-step heating process including a first heating step in which a heating rate in a temperature range of 600° C. or higher and lower than the Ac1 transformation temperature is 5° C./s or less, and a second heating step distinct from the first heating step in which a heating rate in a temperature range from the Ac1 transformation temperature to an annealing temperature is 2° C./s or more, the annealing temperature being equal to or higher than the Ac1 transformation temperature and 860° C. or lower, and an annealing time being 10 seconds or more and 200 seconds or less.

5. A method for manufacturing a coated steel sheet, the method comprising performing a coating treatment on the surface of the cold-rolled steel sheet according to claim 1.

6. A coated steel sheet having a coating layer on the surface of the cold-rolled steel sheet according to claim 2.

7. A method for manufacturing the cold-rolled steel sheet according to claim 2, the method comprising performing annealing on a cold-rolled steel sheet under conditions including a two-step heating process, the two-step heating process including a first heating step in which a heating rate in a temperature range of 600° C. or higher and lower than the Ac1 transformation temperature is 5° C./s or less, and a second heating step distinct from the first heating step in which a heating rate in a temperature range from the Ac1 transformation temperature to an annealing temperature is 2° C./s or more, the annealing temperature being equal to or higher than the Ac1 transformation temperature and 860° C. or lower, and an annealing time being 10 seconds or more and 200 seconds or less.

8. A method for manufacturing a coated steel sheet, the method comprising performing a coating treatment on the surface of the cold-rolled steel sheet according to claim 2.

* * * * *